US011682846B2

(12) United States Patent
Dolatsha et al.

(10) Patent No.: US 11,682,846 B2
(45) Date of Patent: Jun. 20, 2023

(54) ANTENNA DEVICE WITH CELL STRUCTURE AND ARRAY OF ANTENNA DEVICES

(71) Applicant: Movandi Corporation, Irvine, CA (US)

(72) Inventors: Nemat Dolatsha, San Jose, CA (US); Alfred Grau Besoli, Irvine, CA (US); Yifan Wang, South Brisbane (AU); Maryam Rofougaran, Rancho Palos Verdes, CA (US); Ahmadreza Rofougaran, Newport Beach, CA (US)

(73) Assignee: Movandi Corporation, Irvine, CA (US)

( * ) Notice: Subject to any disclaimer, the term of this patent is extended or adjusted under 35 U.S.C. 154(b) by 64 days.

(21) Appl. No.: 17/493,995

(22) Filed: Oct. 5, 2021

(65) Prior Publication Data

US 2022/0294124 A1 Sep. 15, 2022

Related U.S. Application Data

(60) Provisional application No. 63/160,481, filed on Mar. 12, 2021.

(51) Int. Cl.

| | |
|---|---|
| ***H01Q 1/48*** | (2006.01) |
| ***H01Q 21/06*** | (2006.01) |
| ***H01Q 9/04*** | (2006.01) |
| ***H01Q 1/52*** | (2006.01) |

(52) U.S. Cl.

CPC ..... *H01Q 21/065* (2013.01); *H01Q 1/48* (2013.01); *H01Q 1/523* (2013.01); *H01Q 9/045* (2013.01); *H01Q 9/0414* (2013.01)

(58) Field of Classification Search

CPC ..... H01Q 21/065; H01Q 1/48; H01Q 1/523; H01Q 9/0414; H01Q 9/045

See application file for complete search history.

(56) References Cited

U.S. PATENT DOCUMENTS

2019/0020110 A1* 1/2019 Paulotto ..... H01Q 5/20

FOREIGN PATENT DOCUMENTS

CN 110676578 A * 1/2020 ..... H01Q 1/38

* cited by examiner

*Primary Examiner* — Dieu Hien T Duong
(74) *Attorney, Agent, or Firm* — Chip Law Group

(57) ABSTRACT

An antenna device includes a first patch radiator and a second patch radiator arranged over the first patch radiator. The antenna device further includes a central ground pin connected substantially at a center portion of the first patch radiator. The antenna device further includes a plurality of conductive feeding pins connected to the first patch radiator and separated by at least one slot of a plurality of slots provides in the first patch radiator. The antenna device further includes a cell structure having a cavity that includes a polygonal-shaped base and a metallic fence arranged at four or more side walls of the cavity. The first patch radiator and the second patch radiators are arranged in the cavity of the cell structure and are at least partially surrounded by the metallic fence such that a plurality of antenna control parameters are decoupled from each other.

20 Claims, 11 Drawing Sheets

ANTENNA DEVICE WITH CELL STRUCTURE AND ARRAY OF ANTENNA DEVICES

CROSS-REFERENCE TO RELATED APPLICATIONS/INCORPORATION BY REFERENCE

This application makes reference to, claims priority to, and claims benefit from U.S. Provisional Application Ser. No. 63/160,481 filed on Mar. 12, 2021. The above-referenced application is hereby incorporated herein by reference in its entirety.

FIELD OF TECHNOLOGY

Certain embodiments of the disclosure relate to telecommunication devices. More specifically, certain embodiments of the disclosure relate to an antenna device with a cell structure, and an array of antenna devices for enhanced performance for 5G and beyond 5G applications.

BACKGROUND

For the advanced high-performance fifth-generation (5G) communication networks, such as millimeter-wave communication, there is a demand for innovative hardware systems and technologies to support millimeter-wave communication effectively and efficiently. Current antenna systems or antenna arrays, such as phased array antenna or other antenna devices, capable of supporting millimeter-wave communication comprise multiple radiating antenna elements spaced in a grid pattern on a flat or curved surface of communication elements, such as transmitters and receivers. Such antenna arrays may produce a beam of radio waves that may be electronically steered to desired directions without the physical movement of the antennas. A beam may be formed by adjusting time delay and shifting the phase of a signal emitted from each radiating antenna element to steer the beam in the desired direction.

Currently, there are many technical challenges in developing an antenna device for 5G and beyond 5G applications without having to compromise on many key antenna parameters. For example, in a typical dual-polarized antenna device, there is a trade-off on impedance matching over a large bandwidth and polarization terminal isolation in the same frequency band. In addition, the over-the-air polarization purity may be degraded, especially for off angles and at the edges of the frequency bands, thereby adversely affecting coverage. In other words, while trying to improve on one aspect of a conventional antenna device, some other aspects or other antenna parameters may be adversely affected, which is not desirable.

Further limitations and disadvantages of conventional and traditional approaches will become apparent to one of skill in the art through comparison of such systems with some aspects of the present disclosure, as set forth in the remainder of the present application with reference to the drawings.

BRIEF SUMMARY OF THE DISCLOSURE

An antenna device with a cell structure, and an array of antenna devices for enhanced performance for 5G and beyond 5G applications, substantially as shown in and/or described in connection with at least one of the figures, as set forth more completely in the claims.

These and other advantages, aspects, and novel features of the present disclosure, as well as details of an illustrated embodiment thereof, will be more fully understood from the following description and drawings.

DETAILED DESCRIPTION OF THE DISCLOSURE

Certain embodiments of the disclosure may be found in an antenna device with a cell structure and an array of antenna devices for enhanced performance for 5G and beyond 5G applications. The disclosed antenna device and the array of antenna devices comprise multiple patch radiators that are arranged over each other and configured to communicate in the same frequency band. The multiple patch radiators are arranged in a specially designed cell structure in such a way that all the key antenna parameters, for example, bandwidth, polarization purity, polarization terminal isolation (i.e., S21), and scan roll-off are decoupled from each other. Alternatively stated, the disclosed antenna device provides significantly enhanced performance as compared to existing antenna devices, for 5G and beyond 5G applications without any compromises on any of the key antenna parameters. As compared to conventional antenna devices and systems, the disclosed antenna device achieves and ensures all of the following at the same time when in operation: a) large bandwidth; b) large polarization isolation, for example, useful for multiple-input and multiple-output (MIMO) scenarios and off-angle radiation roll-off control (i.e., to lower roll-off in off-angle radiations); c) Large S21 (Horizontal/Vertical polarization terminals) isolation improvement; d) Small scan roll-off, especially for mmWave communication, for improving field-of-view, i.e., coverage); and lastly e) less sensitivity to fabrication imperfections (i.e., avoids small gap or traces). The disclosed antenna device and the array of antenna devices thus enhance the wireless communication capacity, coverage, and reliability for high-performance communication for 5G and beyond 5G applications. In the following description, reference is made to the accompanying drawings, which form a part hereof, and in which is shown, by way of illustration, various embodiments of the present disclosure.

Figure 1A:
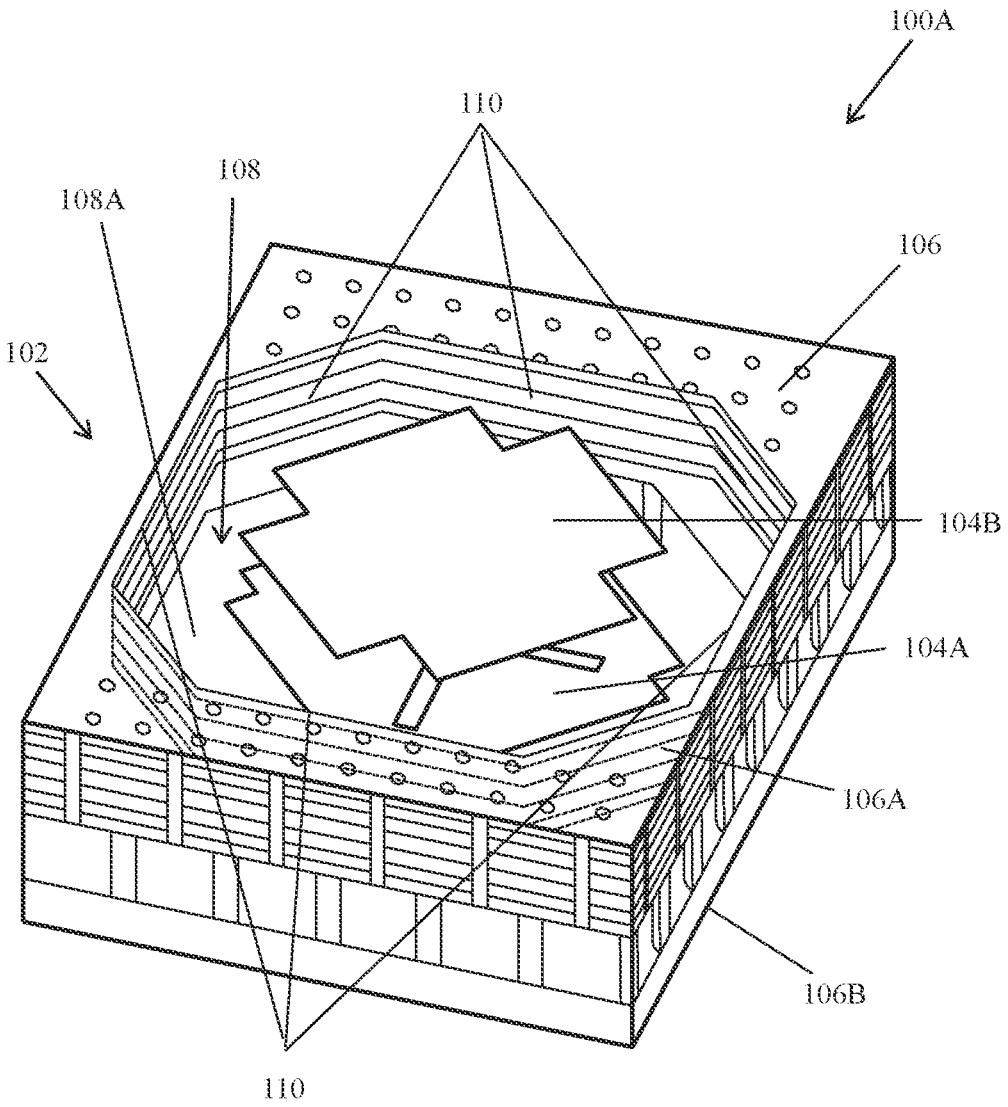
FIG. 1A is a diagram illustrating a perspective view of an exemplary antenna device, in accordance with an exemplary embodiment of the disclosure.

FIG. 1A is a diagram illustrating a perspective view of an exemplary antenna device, in accordance with an exemplary embodiment of the disclosure. With reference to FIG. 1A, there is shown a perspective view 100A of an antenna device 102.

The antenna device 102 enables data communication at a multi-gigabit data rate and operates in the same frequency band. The frequency band may belong to 5G or beyond 5G frequency band. The antenna device 102 may be used in a communication apparatus. Examples of the communication apparatus may include, but is not limited to, a repeater device, a 5G wireless access point, an evolved-universal terrestrial radio access-new radio (NR) dual connectivity (EN-DC) communication device, an NR-enabled cellular repeater device, a wireless local area network (WLAN)-enabled device, a home router, a MIMO-capable repeater device, a base station, such as a gNB, a small cell, a user equipment, or a network node.

The antenna device 102 may include two or more patch radiators, such as a first patch radiator 104A and a second patch radiator 104B. The antenna device 102 may further include a unit cell structure, such as a cell structure 106. The two or more patch radiators, such as the first patch radiator 104A and the second patch radiator 104B, may be configured to radiate in a defined frequency band (i.e., in the same frequency band of interest). The defined frequency band may be a mmWave frequency band. The second patch radiator 104B may be arranged over the first patch radiator 104A at a defined distance, for example, approximately 200 micrometer. In an example, the defined distance may be less than the size (e.g., a length or breadth) of the first patch radiator 104A. In another example, the defined distance may be less than or equal to half of the size (e.g., a length or breadth) of the first patch radiator 104A. The arrangement of the two or more patch radiators, such as the first patch radiator 104A and the second patch radiator 104B, may be in a stacked form, while both of the first patch radiator 104A and the second patch radiator 104B operates in the same frequency band, which enables to achieve a large bandwidth as compared to existing antenna systems.

The cell structure 106 may have a cavity 108. The cavity 108 of the cell structure 106 may comprise a polygonal-shaped base 108A and a metallic fence (e.g., the metallic fence 108B of FIG. 1B) arranged at four or more side walls (such as side walls 110) of the cavity 108. In this embodiment, the cavity 108 of the cell structure 106 may have an octagonal bowl-like structure having an octagonal-base surface. In this case, the polygonal-shaped base 108A may be the octagonal-base surface. An interior of the octagonal bowl-like structure may have eight side walls (such as the side walls 110) arranged in the form of an octagon. The metallic fence may thus be arranged at the eight side walls, such as the side walls 110.

In accordance with an embodiment, the cell structure 106 may have a geometrical shape of a rectangular prism, a square prism, or a cuboidal-like geometrical shape, having the cavity 108. The cell structure 106 may have a first end 106A and a second end 106B. The first end 106A may include the cavity 108, which may be an open radiating end to allow the two or more patch radiators, such as the first patch radiator 104A and the second patch radiator 104B, to radiate in the defined frequency band. The second end 106B may be a closed end at which a ground of the antenna device 102 may be provided. An example of the ground is shown and described, for example, in FIG. 1F.

The two or more patch radiators, such as the first patch radiator 104A and the second patch radiator 104B, may be arranged in the cavity 108 of the cell structure 106 and may be at least partially surrounded by the metallic fence such that a plurality of antenna control parameters may be decoupled from each other. The plurality of antenna control parameters may comprise a bandwidth, a polarization purity, a polarization terminal isolation, and a scan roll-off parameter. The plurality of antenna control parameters may be key antenna control parameters, which are all improved at the same time without any comprise on other antenna parameters as a result of the arrangement of the various components of the antenna device 102 including the cell structure 106. The two or more patch radiators, such as the first patch radiator 104A and the second patch radiator 104B, may be made of electrically conducting material, such as copper, or other conducting metals or metal alloys.

Figure 1B:
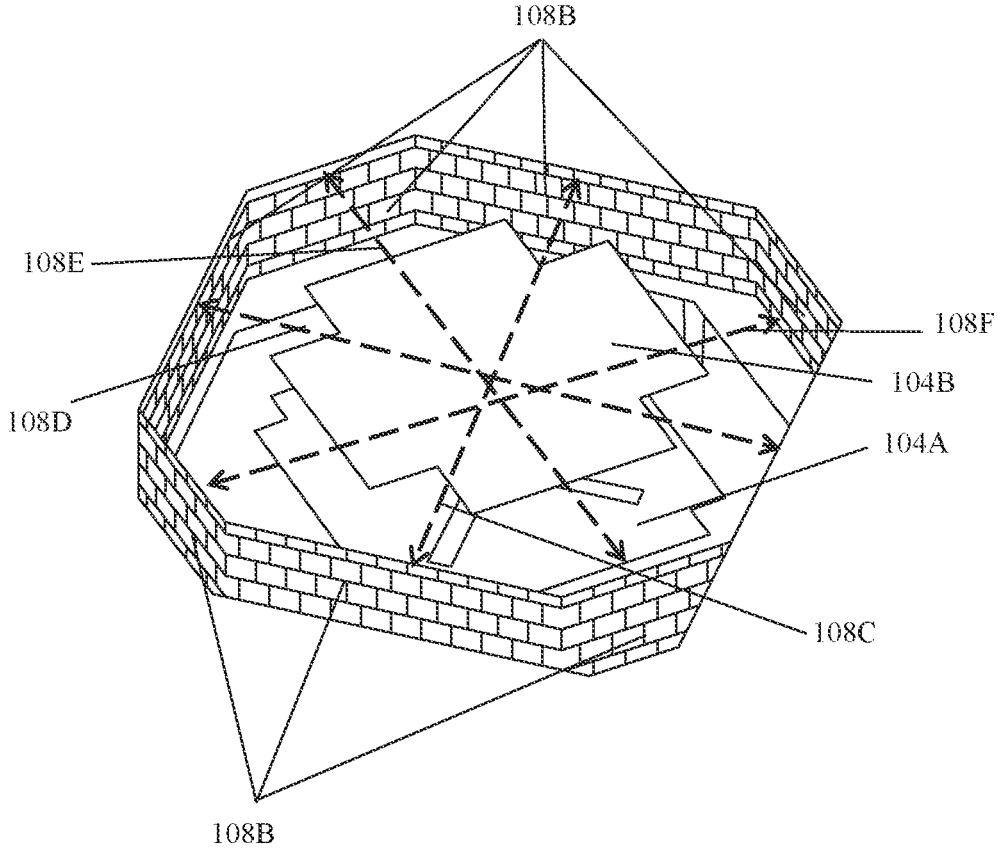
FIG. 1B is a diagram illustrating a metallic fence of a cell structure of the antenna device of FIG. 1A, in accordance with an exemplary embodiment of the disclosure.

FIG. 1B is a diagram illustrating a metallic fence of a cell structure of the antenna device of FIG. 1A, in accordance with an exemplary embodiment of the disclosure. With reference to FIG. 1B, there is shown a metallic fence 108B that partially surrounds the first patch radiator 104A and the second patch radiator 104B when the first patch radiator 104A and the second patch radiator 104B are arranged in the cavity 108 of the cell structure 106. The metallic fence 108B may have a net-like frame structure of thin metallic wires provided at the four or more walls, such as the side walls 110. Thus, in a case where the cavity 108 has eight side walls arranged in the form of an octagon, for example, as shown in FIG. 1A, the metallic fence 108B forms an octagonal net-like structure that laterally surrounds the two or more patch radiators, such as the first patch radiator 104A and the second patch radiator 104B arranged in a stacked form in the cavity 108 of the cell structure 106, as shown, for example, in FIG. 1B. Alternatively stated, the metallic fence 108B may include multi-level metallic rings that are interconnected with metal linings forming the octagonal net-like structure. The metal linings (e.g., vertical interconnections) may pass through vias provided in the cell structure 106. An example of vias is shown and described, for example, in FIG. 1C. The metallic fence 108B may be made of electrically conducting material. In an implementation, the metallic fence 108B may be made of copper. In another implementation, the metallic fence 108B may be made of silver, aluminum, or metal alloys of electrically conducting metals. Along with other arrangements of components of the antenna device 102, the metallic fence 108B significantly improves the polarization isolation and bandwidth of the antenna device 102. Moreover, dimensions of the metallic fence 108B also contribute to control the polarization leakage and bandwidth of the antenna device 102. In an example, each of a length 108C or a breadth 108D of the metallic fence 108B (or a diagonal length of the cavity 108, such as dimension 108E) may be less than twice the length of the first patch radiator 104A for some applications, for example, for some frequency band of interest, such as 24.25 to 27.5 GHz band in one example. However, in some cases, for example, in case of high dielectric constant (Dk) dielectric material used in the cell structure 106, and depending on a frequency band of interest, each of the length 108C and the breadth 108D of the metallic fence 108B or the cavity 108 (or the diagonal length of the metallic fence 108B or the cavity 108, such as the dimension 108E) may be greater than twice the length of the first patch radiator 104A. In an example, the cell structure 106 mostly may be made of a polymeric material. In an implementation, for example, for the 24.25-27.5 GHz frequency band of interest, the length 108C may be approximately 4.8 millimeter (mm), the breadth 108D may be approximately 4.9 mm, and the diagonal length of the metallic fence 108B and the cavity 108, such as dimension 108E, may be approximately 5.37 mm. In another implementation, for example, for one or more different frequency bands of interest in 5G and beyond 5G applications, the length 108C and the breadth 108D may range from 3.5-5.5 mm, and the diagonal length of the metallic fence 108B (and the cavity 108), such as dimension 108E, may range from 4.5-6.5 mm. The length 108C, the breadth 108D, and the diagonal length of the metallic fence 108B or the cavity 108, such as the dimension 108E, refers to dimensions taken from mouth (i.e., from the first end 106A) of the cell structure 106. In one implementation, the length 108C, the breadth 108D, and the diagonal length of the metallic fence 108B or the cavity 108, such as the dimension 108E, may be same at the first end 106A (i.e., the open radiating end) and the second end 106B of the cell structure 106. In another implementation, the length 108C, the breadth 108D, and the diagonal length of the metallic fence 108B or the cavity 108 (such as the dimension 108E) may be different at the first end 106A (i.e., the open radiating end) and the second end 106B of the cell structure 106. For example, the length 108C, the breadth 108D, and the diagonal length of the metallic fence 108B or the cavity 108 (such as the dimension 108E) may be less at the second end 106B of the cell structure 106 as compared to the first end 106A (i.e., the open radiating end). For instance, a diagonal length (e.g., dimension 108F) of the metallic fence 108B or the cavity 108 at the second end 106B (i.e., at the polygonal-shaped base 108A) may be less (e.g., about 4.57 mm) than the diagonal length (e.g., the dimension 108E) of the metallic fence 108B or the cavity 108 at the first end 106A (e.g., about 5.37 mm) of the cell structure 106.

Alternatively stated, when in operation, the metallic fence 108B contributes to the decoupling of the plurality of antenna control parameters, such as the bandwidth, the polarization purity, and the scan roll-off parameter, and further adds more degrees of freedom to control the antenna parameters, for example, by changing the dimensions according to a given use case in 5G or beyond 5G.

Figure 1C:
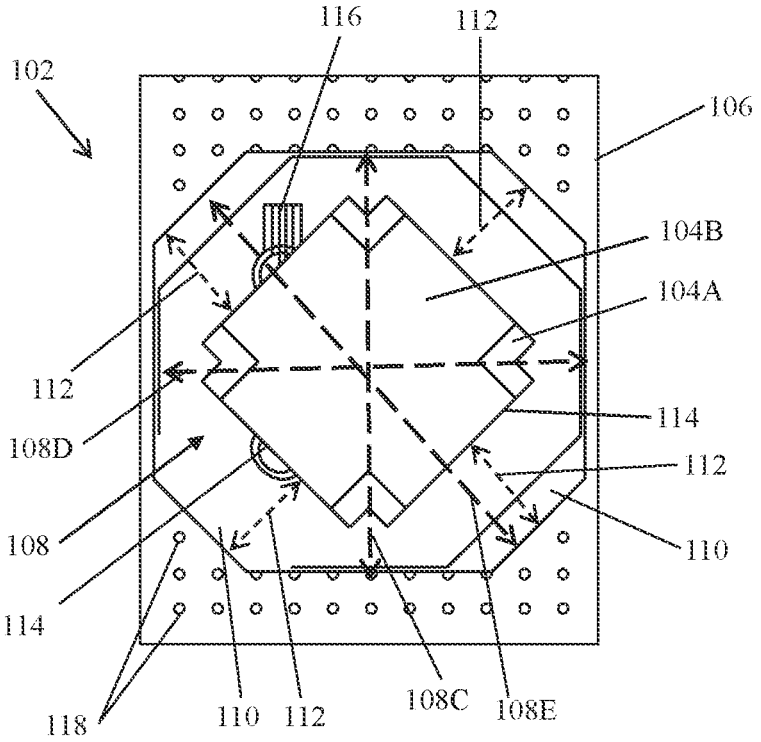
FIG. 1C is a diagram illustrating a top view of the antenna device of FIG. 1A, in accordance with an exemplary embodiment of the disclosure.

FIG. 1C is a diagram illustrating a top view of the antenna device of FIG. 1A, in accordance with an exemplary embodiment of the disclosure. With reference to FIG. 1C, there is shown a top view of the antenna device 102. The first patch radiator 104A and the second patch radiator 104B are arranged in a stacked form in the cavity 108 of the cell structure 106 such that a gap 112 is defined between the metallic fence 108B and different edges (such as edges 114) of the first patch radiator 104A and the second patch radiator 104B in the cavity 108 of the cell structure 106. The cell structure 106 that includes the gap 112 between the metallic fence 108B and different edges (such as edges 114) of the first patch radiator 104A and the second patch radiator 104B, ensures less sensitivity to fabrication errors or imperfections for consistent enhanced performance. The size of the first patch radiator 104A may be different from the second patch radiator 104B. For example, the size of the first patch radiator 104A may be greater than the second patch radiator 104B. Each edge (such as each of the edges 114) of each of the first patch radiator 104A and the second patch radiator 104B may be arranged parallel to a corresponding side wall of the four or more side walls (such as the side walls 110) of the cavity 108 of the cell structure 106. There is further shown the length 108C, the breadth 108D, and the diagonal length between two side walls, such as the dimension 108E, of the cavity 108. It is to be understood that the dimensions of the cavity 108 may be approximately same as that of the metallic fence 108B, as shown in FIG. 1B, in an example.

In the FIG. 1C, there is further shown a power distribution terminal 116 and a plurality of vias 118. The power distribution terminal 116 may be used to establish an electrical connection from one cell structure 106 to another cell structure in an array of antenna devices. An example of the array of antenna devices is shown and described, for example, in FIG. 2A. For example, one horizontal polarization feeding pin of one cell structure may be coupled with another horizontal polarization feeding pin of another cell structure via a corresponding power distribution terminal. Similarly, one vertical polarization feeding pin of one cell structure may be coupled with another vertical polarization feeding pin of another cell structure via another corresponding power distribution terminal. The plurality of vias 118 may be used to establish an electrical connection from one component to another of the antenna device 102 as per need. For example, the metal linings or interconnections of the metallic fence 108B may pass through the plurality of vias 118 provided in the cell structure 106.

Figure 1D:
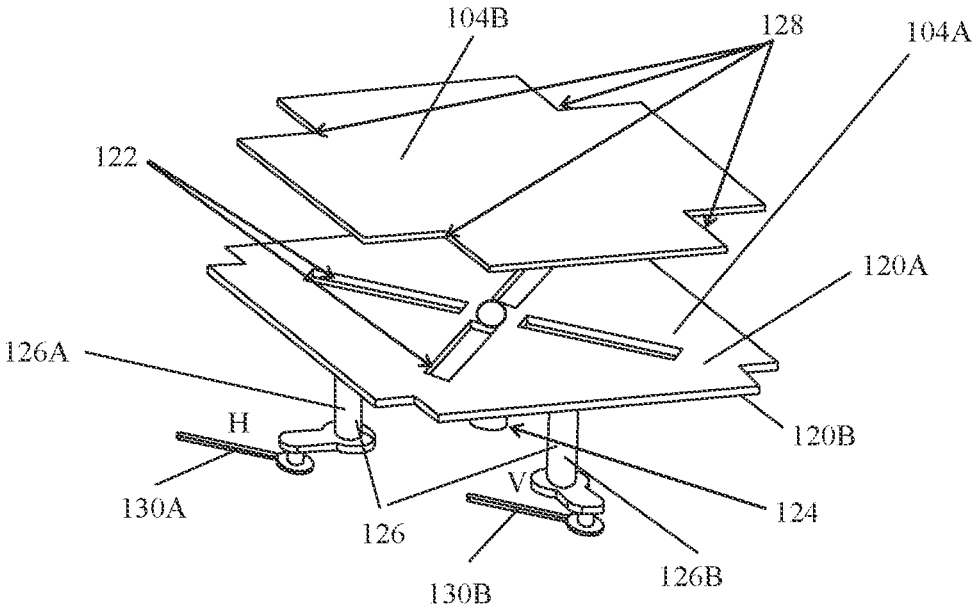
FIG. 1D is a diagram illustrating a perspective view of an arrangement of patch radiators in a stacked form in the antenna device of FIG. 1A, in accordance with an exemplary embodiment of the disclosure.

FIG. 1D is a diagram illustrating a perspective view of an arrangement of patch radiators in a stacked form in the antenna device of FIG. 1A, in accordance with an exemplary embodiment of the disclosure. With reference to FIG. 1D, there is shown the second patch radiator 104B arranged over the first patch radiator 104A at a defined distance, for example, in the range of 180-300 μm (micrometer). In an implementation, the second patch radiator 104B may be arranged over the first patch radiator 104A at a distance of approximately 200 μm. In an example, the defined distance may be less than the size (e.g., a length or breadth) of the first patch radiator 104A. In another example, the defined distance may be less than or equal to the half of the size (e.g., a length or breadth) of the first patch radiator 104A.

The first patch radiator 104A has a first side 120A and a second side 120B. The first side 120A of the first patch radiator 104A faces the second patch radiator 104B and the second side 120B of the first patch radiator faces a ground of the antenna device 102. The first patch radiator 104A comprises a plurality of slots 122. The plurality of slots 122 are provided on the first patch radiator 104A for decoupling matching from "S21". The "S21" is an 5-parameter that represents the power transferred from a first port 130A (Port 1) to a second port 130B (Port 2). In this case, the first port 130A (i.e., Port 1) may be a horizontal polarization feed terminal and the second port 130B (Port 2) may be a vertical polarization feed terminal.

The antenna device 102 further comprises a central ground pin 124 that may have a first end connected substantially at a center portion of the second side 120B of the first patch radiator 104A and a second end connected to the ground of the antenna device 102. The arrangement of the central ground pin 124 at the center portion of the second side 120B of the first patch radiator 104A is made to achieve enhanced polarization isolation as compared to existing antenna devices, arrays, and systems.

The antenna device 102 further comprises a plurality of conductive feeding pins 126 connected to the second side 120B of the first patch radiator 104A and separated by at least one slot of the plurality of slots 122. The plurality of slots 122 may be added to control (i.e., to increase) a current path between the plurality of conductive feeding pins 126 including the two ports 130A and 130B (H/V) with minimum effect on the matching and yet enabling the isolation enhancement in the defined frequency band in which the antenna device 102 operates. In this implementation, the plurality of conductive feeding pins 126 may comprise a combination of one horizontal polarization feeding pin 126A and one vertical polarization feeding pin 126B. However, in some implementations, the plurality of conductive feeding pins 126 may comprise a combination of two horizontal polarization feeding pins and two vertical polarization feeding pins. Each of the plurality of conductive feeding pins 126 may have a first end and a second end. The first end may be connected to the second side 120B of the first patch radiator 104A, whereas the second end may be connected to a corresponding port of the two ports 130A and 130B.

In accordance with an embodiment, each of the first patch radiator 104A and the second patch radiator 104B may be a square-shaped patch radiator with four L-shaped notched corners 128. The cutting of the patch corners in the form of the L-shaped notched corners 128 for each of the first patch radiator 104A and the second patch radiator 104B enables to achieve better polarization purity as compared to existing antenna systems. The cutting of the patch corners in the form of the L-shaped notched corners 128 reduces current density at the corners and consequently reduces the polarization leakage.

Figure 1E:
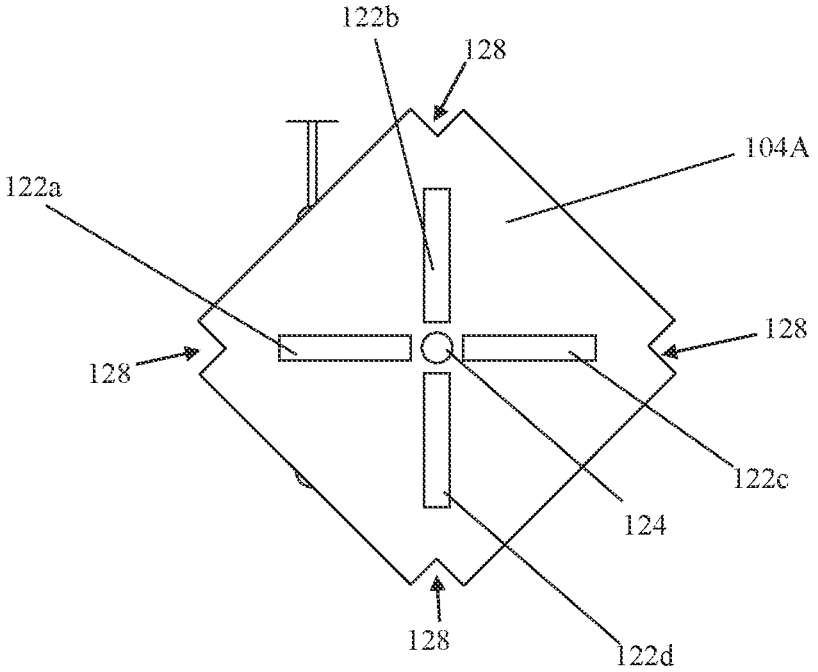
FIG. 1E is a diagram illustrating a top view of a first patch radiator of the antenna device of FIG. 1A, in accordance with an exemplary embodiment of the disclosure.

FIG. 1E is a diagram illustrating a top view of a first patch radiator of the antenna device of FIG. 1A, in accordance with an exemplary embodiment of the disclosure. With reference to FIG. 1E, there is shown the first patch radiator 104A that may comprise four slots 122*a*, 122*b*, 122*c*, and 122*d*, wherein each of four slots 122*a*, 122*b*, 122*c*, and 122*d* extends from near the central ground pin 124 towards the four L-shaped notched corners 128.

Figure 1F:
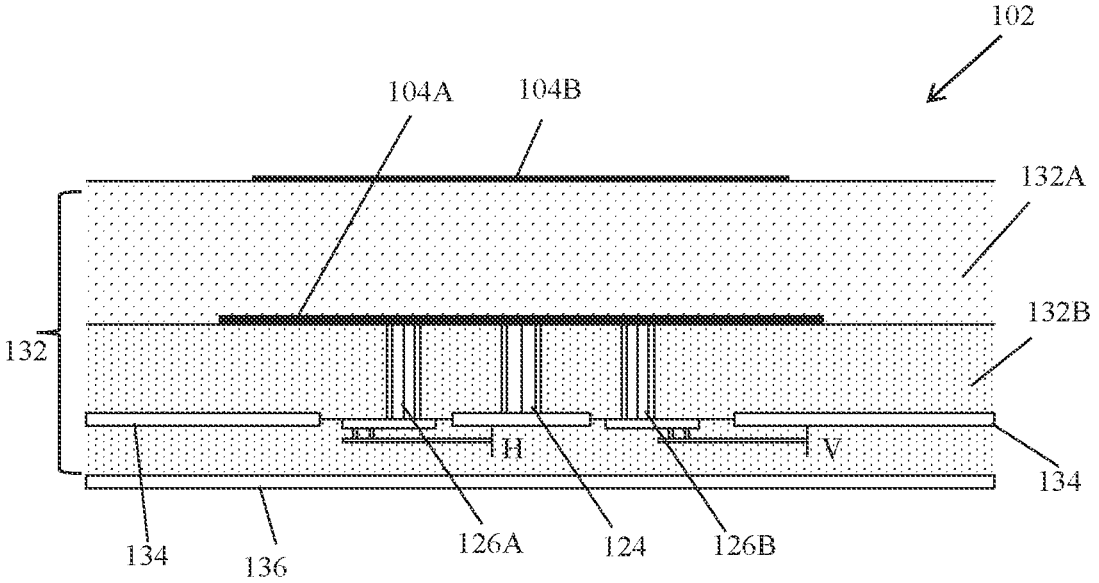
FIG. 1F is a diagram illustrating a side view of the antenna device 102 of FIG. 1A, in accordance with an exemplary embodiment of the disclosure.

FIG. 1F is a diagram illustrating a side view of the antenna device 102 of FIG. 1A, in accordance with an exemplary embodiment of the disclosure. With reference to FIG. 1F, there is shown a side view of the antenna device 102 to depict arrangement of various components of the antenna device 102 (without the cell structure 106).

The antenna device 102 may further comprise a multi-layered printed circuit board (PCB) 132. The second patch radiator 104B may be printed on a first layer 132A of the multi-layered PCB 132. The first patch radiator 104A may be sandwiched between the first layer 132A and a second layer 132B of the multi-layered PCB 132. There is further shown the central ground pin 124 having a first end connected substantially at a center portion of the first patch radiator 104A and a second end connected to a ground 134 of the antenna device 102. Similarly, there is further shown the plurality of conductive feeding pins, such as a combination of one horizontal polarization feeding pin 126A and one vertical polarization feeding pin 126B, connected to the first patch radiator 104A at one end and the ground 134 at the other end. In an implementation, the antenna device 102 may further include a reflector 136 that may be used to reflect electromagnetic waves, such as the mmWave, when in operation. The reflector 136 may be part of the antenna device 102 or may be part of an antenna assembly in an antenna array of antenna devices.

In an example, the antenna device 102 manifests the following advantages and at least the following features in combination and as a whole are complementary to each other and synergistic in nature, for example:

(i) the arrangement of the two or more patch radiators in the stacked form, while both of the first patch radiator 104A and the second patch radiator 104B operates in the same frequency band enables to achieve a large bandwidth without compromising any of the polarization purity, the polarization terminal isolation, and the scan roll-off parameter of the antenna device 102;

(ii) the two or more patch radiators, such as the first patch radiator 104A and the second patch radiator 104B, which may be configured to radiate in the defined frequency band (i.e., in the same frequency band of interest), may further contribute to the improvement of bandwidth of the antenna device 102;

(iii) the arrangement of the plurality of slots 122 on the first patch radiator 104A further enables decoupling matching from "S21" without adversely affecting other antenna parameters, such as bandwidth and scan roll-off parameter;

(iv) the arrangement of the central ground pin 124 at the center portion of the second side 120B of the first patch radiator 104A further compliments and enables enhanced polarization isolation;

(v) the placement of the plurality of conductive feeding pins 126 at the first patch radiator 104A, which are separated by at least one slot of the plurality of slots 122 further improves polarization isolation. For example, the plurality of slots 122 increases the current path between the plurality of conductive feeding pins 126 including the two ports 130A and 130B (H/V) with minimum effect on the matching and yet enabling the isolation enhancement in the defined frequency band in which the antenna device 102 operates;

(vi) the cutting of the patch corners, such as the four L-shaped notched corners 128, for each of the first patch radiator 104A and the second patch radiator 104B, reduces current density at the corners and consequently reduces the polarization leakage; and (vii) the two or more patch radiators, such as the first patch radiator 104A and the second patch radiator 104B, arranged in the cavity 108 of the cell structure 106 and at least partially surrounded by the metallic fence 108B further ensures that the plurality of antenna control parameters, i.e., the bandwidth, the polarization purity, the polarization terminal isolation, and the scan roll-off parameter are decoupled from each other.

Thus, as compared to conventional antenna devices and systems, the antenna device 102 achieves and ensures all of the following effects concomitantly when in operation: a) large bandwidth; b) large polarization isolation, for example, useful for multiple-input and multiple-output (MIMO) scenarios and off-angle radiation roll-off control (i.e., to lower roll-off in off-angle radiations); c) Large S21 (Horizontal/Vertical polarization terminals) isolation improvement; d) Small scan roll-off, especially for mmWave communication, for improving field-of-view, i.e., coverage); and lastly e) less sensitivity to fabrication imperfections (i.e., avoids small gap or traces). As a result, the antenna device 102 manifests significant performance improvement in terms of wireless communication capacity, coverage, and reliability for high-performance communication for 5G and beyond 5G applications. Some examples of the improvement achieved by the antenna device 102 has been described, for example, in FIG. 3A to 3D.

Figure 2A:
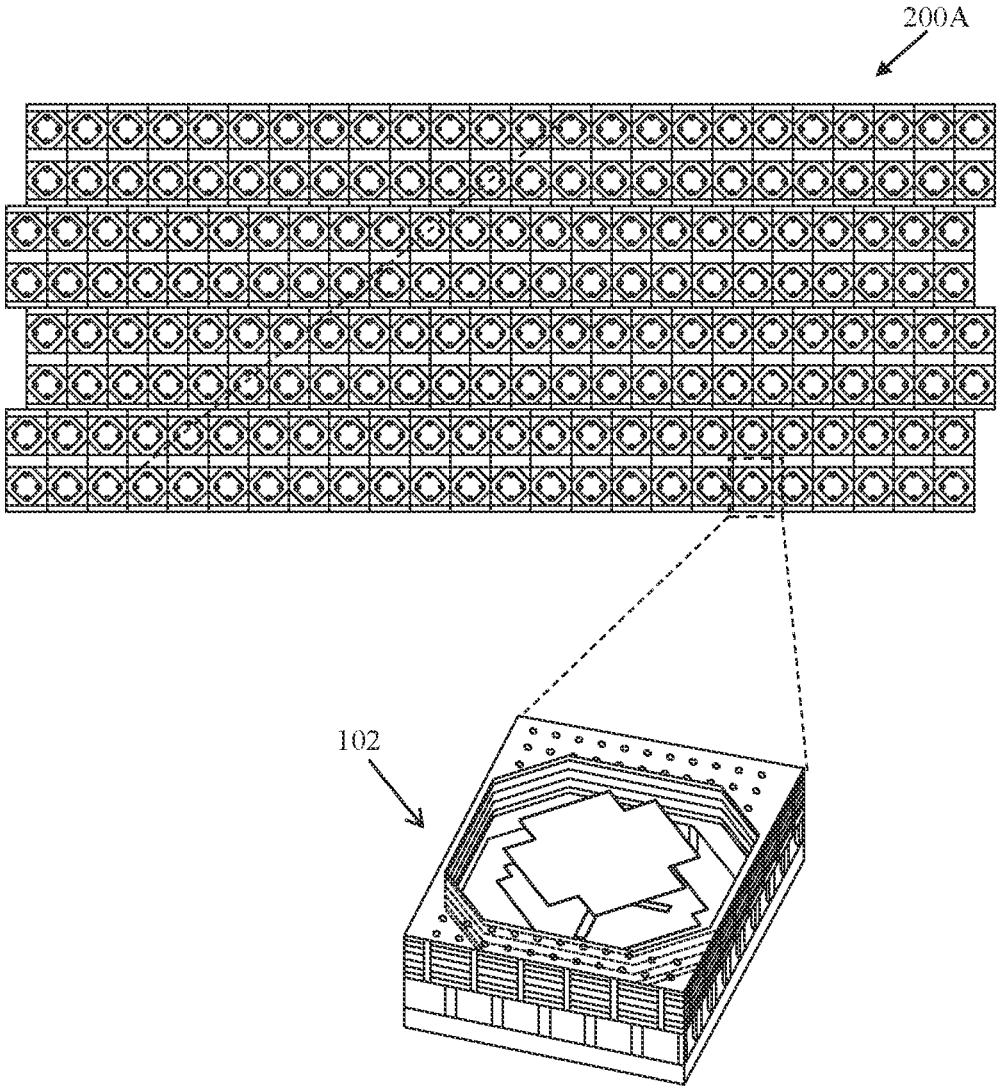
FIG. 2A is a diagram illustrating an array of antenna devices with an enlarged view of an antenna device of FIG. 1A, in accordance with an exemplary embodiment of the disclosure.

FIG. 2A is a diagram illustrating an array of antenna devices with an enlarged view of an antenna device of FIG. 1A, in accordance with an exemplary embodiment of the disclosure. With reference to FIG. 1G, there is shown an array 200A of antenna devices that may comprises a plurality of antenna devices, such as the antenna device 102 having a single cavity cell structure, where each antenna device 102 may be arranged in a M×N antenna array, where "M" stands for a number of rows and "N" stands for a number of columns in the array 200A of antenna devices. In this implementation, an exemplary 24×8 antenna array is shown for explanation purposes.

Figure 2B:
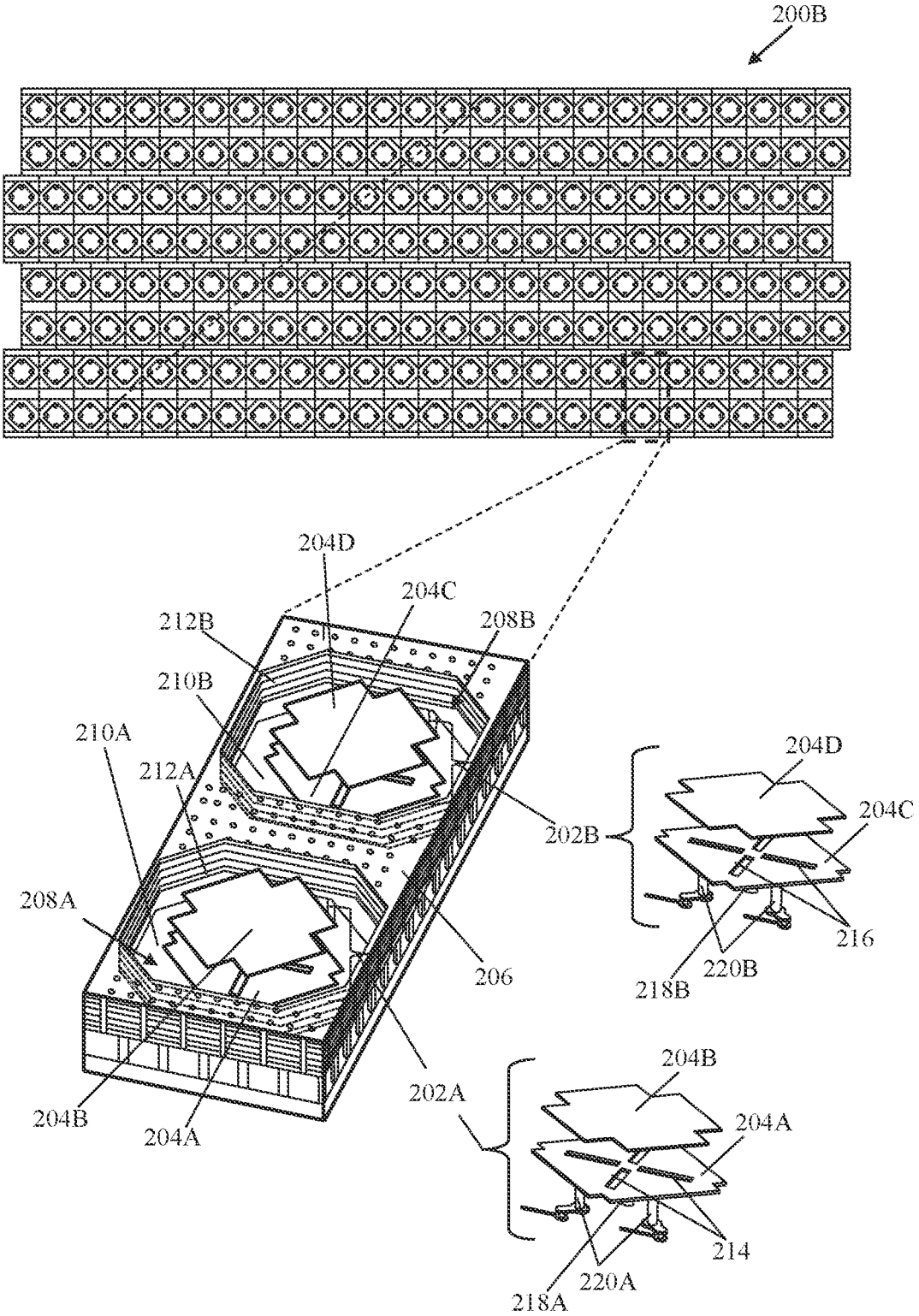
FIG. 2B is a diagram illustrating an array of antenna devices, in accordance with another exemplary embodiment of the disclosure.

FIG. 2B is a diagram illustrating an array of antenna devices, in accordance with another exemplary embodiment of the disclosure. With reference to FIG. 2B, there is shown an array 200B of antenna devices with an enlarged view of two cavity unit cell, i.e., a cell structure 206 having a plurality of cavities 208A and 208B. The array 200B of antenna devices may be similar to that of the array 200A of antenna devices except that a cell structure 206 may have the plurality of cavities 208A and 208B instead of a single cavity to accommodate two stacks of patch radiators. Thus, the cell structure 206 may also be referred to as a two-element unit cell. The array 200B of antenna devices is described by taking an example of one dual-cavity unit cell, such as the cell structure 206. However, it is to be understood that multiple dual-cavity unit cell may be arranged in a grid of M×N rows and columns in practice, as shown in FIG. 2B, in an example.

The array 200B of antenna devices may comprise a first arrangement 202A of patch radiators. The first arrangement 202A of patch radiators may comprise a first patch radiator 204A and a second patch radiator 204B arranged over the first patch radiator 204A at a defined distance. The first patch radiator 204A may comprise a first plurality of slots 214. The first arrangement 202A of patch radiators may further comprise a first central ground pin 218A having a first end connected substantially at a center portion of the first patch radiator 204A and a second end connected to a ground of the first arrangement 202A of patch radiators. The ground is same as that shown and described, for example, in FIG. 1F and omitted here for the sake of brevity. The first arrangement 202A of patch radiators may further comprise a first plurality of conductive feeding pins 220A connected to the first patch radiator 204A and separated by at least one slot of the plurality of slots 214.

The array 200B of antenna devices may further comprise a second arrangement 202B of patch radiators. The second arrangement 202B of patch radiators may comprise a third patch radiator 204C and a fourth patch radiator 204D arranged over the third patch radiator 204C at the defined distance. The third patch radiator 204C may comprise a second plurality of slots 216. The second arrangement 202B of patch radiators may further comprise a second central ground pin 218B having a first end connected substantially at a center portion of the third patch radiator 204C and a second end connected to a ground of the second arrangement 202B of patch radiators. The second arrangement 202B of patch radiators may further comprise a second plurality of conductive feeding pins 220B connected to the third patch radiator 204C and separated by at least one slot of the second plurality of slots 216. The size of the first patch radiator 204A and the third patch radiator 204C is greater than the second patch radiator 204B and the fourth patch radiator 204D, respectively.

In accordance with an embodiment, each of the first plurality of conductive feeding pins 220A and the second plurality of conductive feeding pins 220B comprises at least one of: a combination of one horizontal polarization feeding pin and one vertical polarization feeding pin, or a combination of two horizontal polarization feeding pins and two vertical polarization feeding pins.

The array 200B of antenna devices may further comprise a cell structure 206 having a plurality of cavities 208A and 208B. Each of the plurality of cavities 208A and 208B may comprise a polygonal-shaped base and a metallic fence arranged at four or more side walls of each cavity. For example, a first cavity 208A may include a polygonal-shaped base 210A and four or more side walls, such as side walls 212A. Similarly, a second cavity 208B may include a polygonal-shaped base 210B and four or more side walls, such as side walls 212B. The first arrangement 202A of patch radiators may be arranged in the first cavity 208A of the plurality of cavities 208A and 208B of the cell structure 206 and is at least partially surrounded by the metallic fence of the first cavity 208A. The second arrangement 202B of patch radiators may be arranged in the second cavity 208B of the plurality of cavities 208A and 208B of the cell structure 206 and is at least partially surrounded by the metallic fence of the second cavity 208B. The arrangement of the metallic fence is the same as that described, for example, in the FIG. 1B for one stack of patch radiators. Thus, for two stacks of patch radiators, i.e., the first arrangement 202A of patch radiators and the second arrangement 202B of patch radiators, there will be two metallic fences, each laterally surrounding each stack of patch radiators. The first arrangement 202A of patch radiators and the second arrangement 202B of patch radiators may be arranged in the first cavity 208A and the second cavity 208B, respectively such that a plurality of antenna control parameters are decoupled from each other. In accordance with an embodiment, the plurality of antenna control parameters comprises a bandwidth, a polarization purity, a polarization terminal isolation, and a scan roll-off parameter.

In accordance with an embodiment, each of the plurality of cavities 208A and 208B of the cell structure 206 has an octagonal bowl-like structure having an octagonal-base surface. The interior of the octagonal bowl-like structure has eight side walls arranged in the form of an octagon. The metallic fence is arranged at the eight side walls of each cavity of the plurality of cavities 208A and 208B. Moreover, each of the first patch radiator 204A, the second patch radiator 204B, the third patch radiator 204C, and the fourth patch radiator 204D may be a square-shaped patch radiator with four L-shaped notched corners (i.e., each with four cut corners), for enhanced polarization purity. Furthermore, in an implementation, each of the first patch radiator 204A and the third patch radiator 204C may comprise four slots, where each of four slot extends from near corresponding central ground pin towards the four L-shaped notched corners.

Figure 2C:
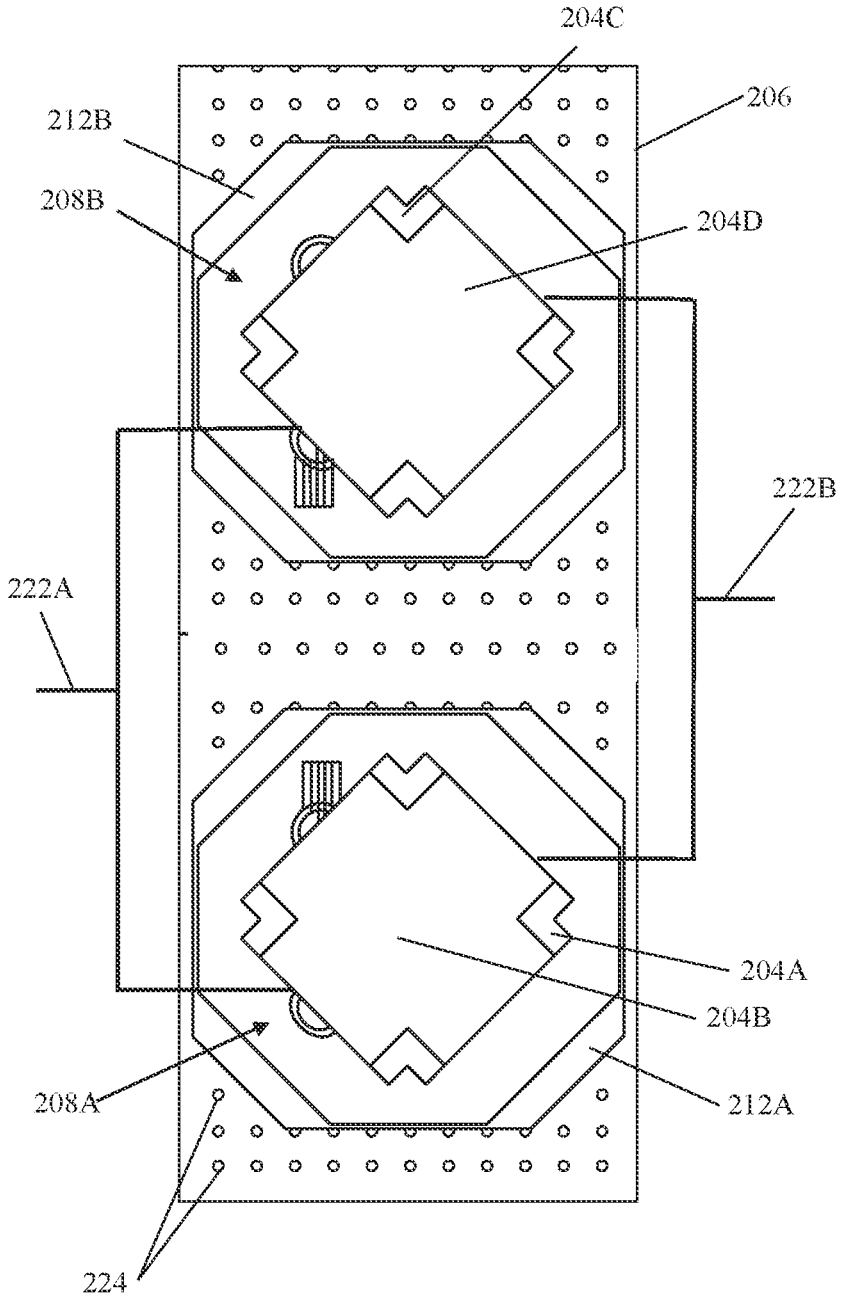
FIG. 2C is a diagram illustrating a top view of an array of antenna devices with a dual-cavity cell structure, in accordance with another exemplary embodiment of the disclosure.

FIG. 2C is a diagram illustrating a top view of an array of antenna devices with a dual-cavity cell structure, in accordance with another exemplary embodiment of the disclosure. FIG. 2C is explained in conjunction with elements from FIGS. 1A to 1F, and 2B. With reference to FIG. 2C, there is shown top view of the array 200B of antenna devices with the dual-cavity cell structure, i.e., the cell structure 206. There is further shown a first power divider 222A, a second power divider 22B, and a plurality of vias 224 in addition to the first patch radiator 204A and the second patch radiator 204B arranged in the first cavity 208A, and the third patch radiator 204C and the fourth patch radiator 204D arranged in the second cavity 208B. There is also shown side walls 212A of the first cavity 208A and the side walls 212B of the second cavity 208B. The first power divider 222A may be used to divide power supply for the first arrangement 202A of patch radiators (which includes the first patch radiator 204A and the second patch radiator 204B arranged in the first cavity 208A) and the second arrangement 202B of patch radiators (which includes the third patch radiator 204C and the fourth patch radiator 204D arranged in the second cavity 208B) for the horizontal polarization. Similarly, the second power divider 222B may be used to divide power supply for the first arrangement 202A of patch radiators and the second arrangement 202B of patch radiators for the vertical polarization. The plurality of vias 224 corresponds to the plurality of vias 118 of FIG. 1C.

In accordance with an embodiment, each edge of each of the first patch radiator 204A, the second patch radiator 204B, the third patch radiator 204C, and the fourth patch radiator 204D may be arranged parallel to a corresponding side wall of the four or more side walls of each cavity of the plurality of cavities 208A and 208B of the cell structure 206. Firstly, the edges of the second patch radiator 204B may be aligned with the edges of the first patch radiator 204A when the second patch radiator 204B is arranged over the first patch radiator 204A. Secondly, when the first arrangement 202A of patch radiators (which includes the first patch radiator 204A and the second patch radiator 204B) are arranged in the first cavity 208A, edges on all four sides of each patch radiator of the first arrangement 202A may be further aligned with respect to side walls of the first cavity 208A such that each edge lie in parallel to a corresponding side wall in the first cavity 208A. A similar arrangement may be made for the second arrangement 202B of patch radiators. For example, the edges of the third patch radiator 204C may be aligned with the edges of the fourth patch radiator 204D when the fourth patch radiator 204D is arranged over the third patch radiator 204C. Thereafter, when the second arrangement 202B of patch radiators are arranged in the second cavity 208B, edges on all four sides of each patch radiator of the second arrangement 202B may be further aligned with respect to side walls of the second cavity 208B such that each edge lie in parallel to a corresponding side wall in the second cavity 208B.

In accordance with an embodiment, a height of the metallic fence arranged at four or more side walls (such as side walls 212A and 212B) of each cavity of the plurality of cavities 208A and 208B may be substantially equal to a corresponding height of each of the first arrangement 202A of patch radiators and the second arrangement 202B of patch radiators when arranged in the cell structure 206. The term substantially equal may refer to approximately equal or about 1-15% difference in height. In other words, each metallic fence arranged around the first arrangement 202A of patch radiators and the second arrangement 202B laterally covers (i.e., surrounds the sides) of the first arrangement 202A of patch radiators and the second arrangement 202B up to the level of the top patch radiator, i.e., the second patch radiator 204B and the fourth patch radiator 204D in this case, as shown, in an example.

Figure 3A:
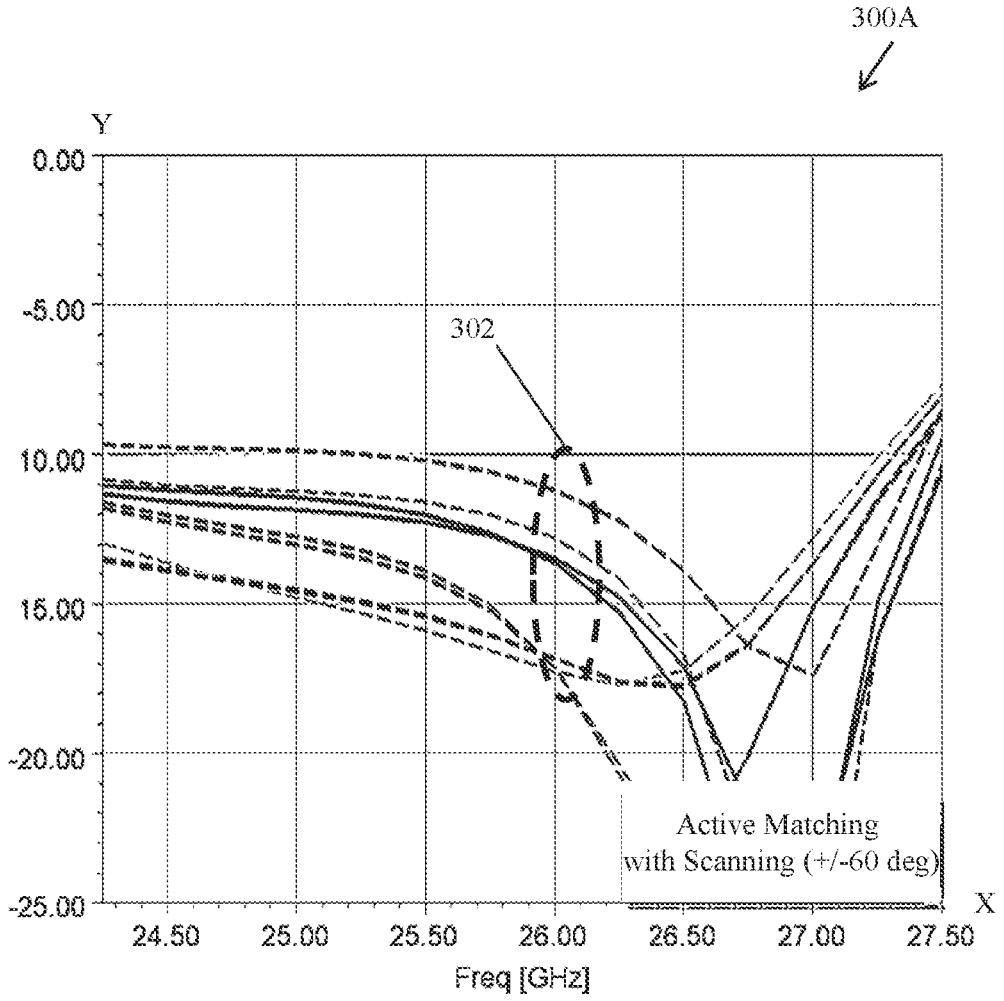
FIG. 3A is a diagram illustrating a graphical representation that depicts matching for a defined range of scan angles in a defined frequency band, in accordance with an exemplary embodiment of the disclosure.

FIG. 3A is a diagram illustrating a graphical representation that depicts matching for a defined range of scan angles in a defined frequency band, in accordance with an exemplary embodiment of the disclosure. FIG. 3A is explained in conjunction with elements from FIGS. 1A to 1F, and 2A to 2C. With reference to FIG. 3A, there is shown a graphical representation 300A that shows a frequency band of interest on its X-axis versus matching (e.g., impedance matching) represented in magnitude of decibels (dB) on its Y-axis. There is further shown different line plots 302 representing active scanning between scan angles of −60 to +60 degrees in the azimuth plane in the frequency band between 24 to 27.5 GHz. In other words, FIG. 3A shows simulation results depicting enhanced performance of the antenna device 102 of FIGS. 1A to 1F, where a large bandwidth of 4 GHz is achieved around 26 GHz frequency for a broadside beam with less than or equal to only 10 dB of return loss, which is almost 15-20% improved bandwidth with respect to the center frequency (i.e., around 26 GHz) of the frequency band of interest. In conventional antenna device, the bandwidth achieved is usually less than 10% for same frequency band and under similar operating conditions.

Figure 3B:
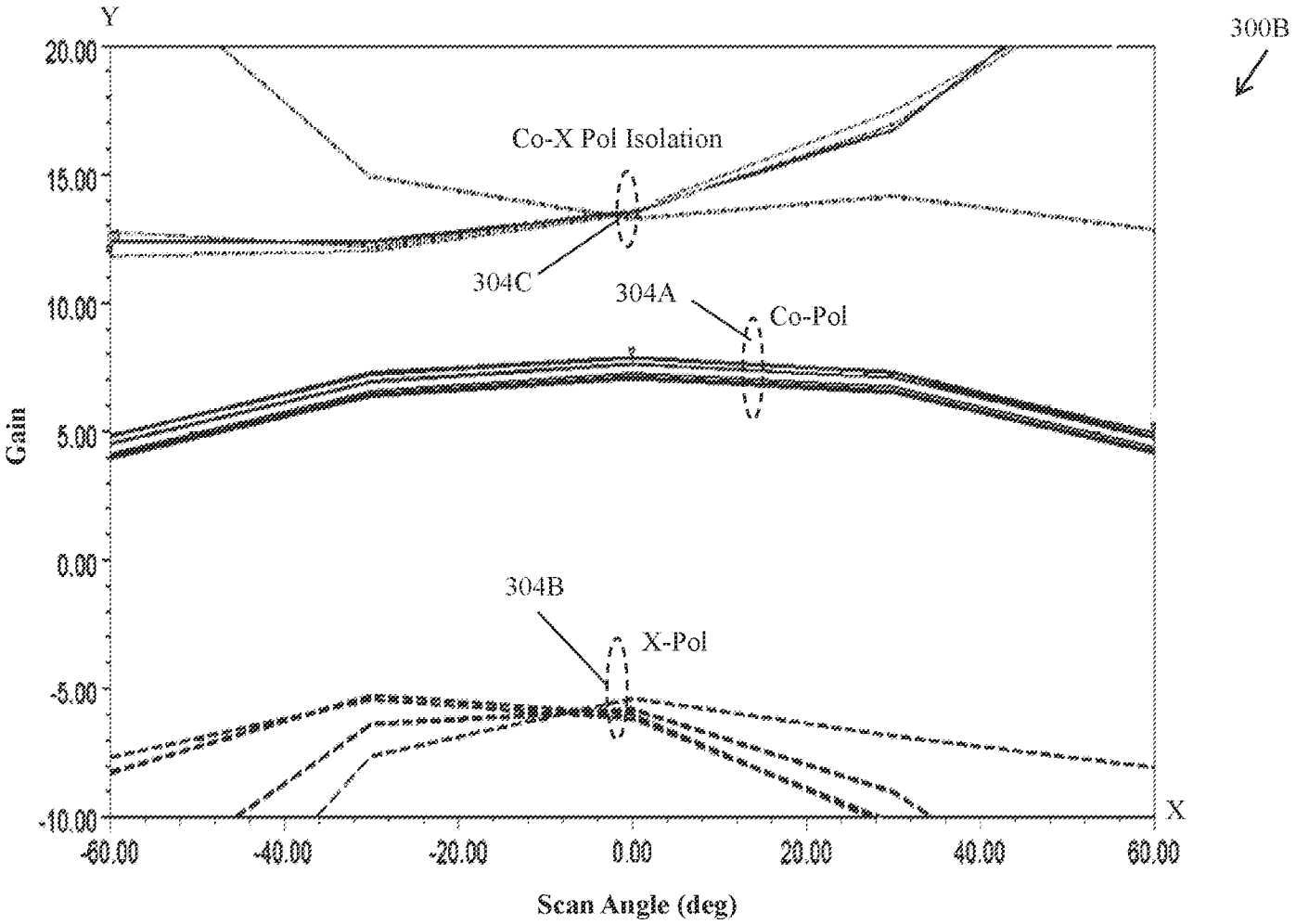
FIG. 3B is a diagram illustrating a graphical representation that depicts scan angles versus realized gain in a defined frequency band for depicting polarization isolation, in accordance with an exemplary embodiment of the disclosure.

FIG. 3B is a diagram illustrating a graphical representation that depicts scan angles versus realized gain in a defined frequency band for depicting polarization isolation, in accordance with an exemplary embodiment of the disclosure. FIG. 3B is explained in conjunction with elements from FIGS. 1A to 1F, and 2A to 2C. With reference to FIG. 3B, there is shown a graphical representation 300B that shows scan angles of −60 to +60 degrees on its X-axis versus realized gain in decibels (dB) on its Y-axis. There is further shown a first set of line plots 304A representing co-polarization, a second set of line plots 304B representing cross-polarization, a third set of line plots 304C representing polarization isolation. The polarization isolation may be an over-the-air (OTA) polarization isolation, which is the difference between the cross-polarization and the co-polarization. Each line plot of first set of line plots 304A corresponds to a different frequency within the frequency band of interest. Similarly, each line plot of the second set of line plots 304B or the third set of line plots 304C corresponds to a different frequency within the frequency band of interest. In other words, FIG. 3B shows simulation results depicting enhanced performance of the antenna device 102 (of FIG. 1A to 1F), and the array 200A and 200B of antenna devices (FIGS. 2A and 2B), where the polarization isolation (i.e., OTA polarization) achieved in all scan angles (e.g., scan angles between −60 to +60 degrees in this case) in all frequencies over the entire frequency band of interest (e.g., 24 to 27.5 GHz in this case) is greater than 12 dB approximately even for the worst cases, which is a significant improvement as compared to conventional antenna systems, where it is usually 8 dB or less for off-angle radiations, for example, at −60 or +60 degree scan angle. Beneficially, even the roll-off at 27.5 GHz and scan angle of 60 degree is 2.9 dB approximately, which is a significant improvement (i.e., small roll-off) as compared to conventional antenna systems.

Figure 3C:
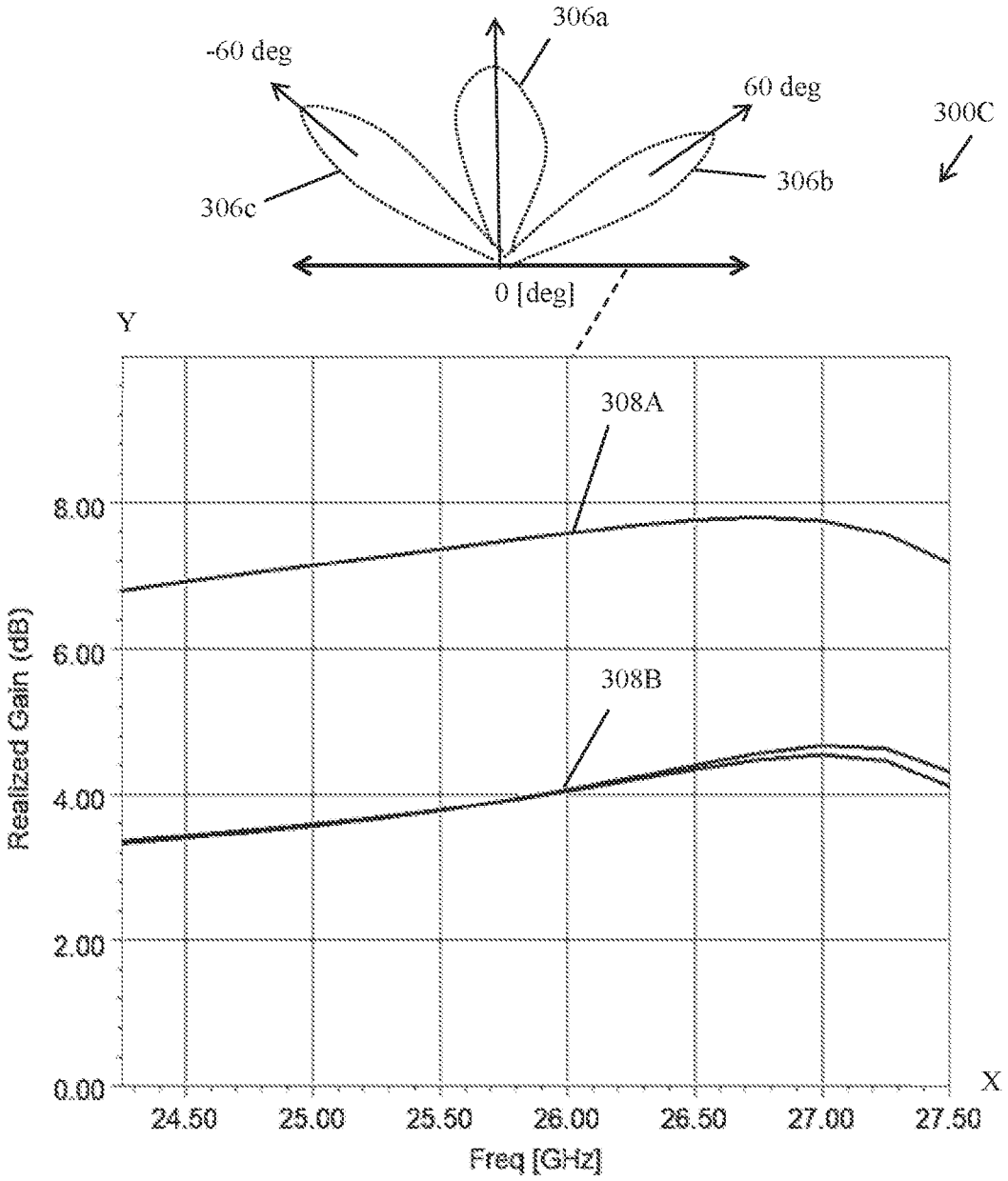
FIG. 3C is a diagram illustrating a graphical representation that depicts frequencies within a defined frequency band versus realized gain for depicting roll-off in the defined frequency band for different scan angles, in accordance with an exemplary embodiment of the disclosure.

FIG. 3C is a diagram illustrating a graphical representation that depicts frequencies within a defined frequency band versus realized gain for depicting roll-off in the defined frequency band for different scan angles, in accordance with an exemplary embodiment of the disclosure. FIG. 3C is explained in conjunction with elements from FIGS. 1A to 1F, and 2A to 2C. With reference to FIG. 3C, there is shown a graphical representation 300C that shows frequencies within a defined frequency band in GHz on its X-axis versus realized gain in decibels (dB) on its Y-axis to depict a roll-off of the realized gain for different scan angles. There is further shown a first beam 306*a* (e.g., a broadside beam) in a zero-degree scan angle (i.e., perpendicular (e.g., a central axis) to the surface of the array 200A or 220B of antenna devices (FIGS. 2A and 2B). There is further shown a second beam 306*b* in a +60-degree scan angle from the central axis and a third beam 306*c* in a −60-scan angle from the central axis, as shown in an example.

There is further shown a first line plot 308A representing realized gain at different frequencies within the frequency band of interest (e.g., from 24.25 to 27.5 GHZ in this case) when the first beam 306*a* is radiated at the zero-degree scan angle. Similarly, there is also shown a second line plot 308B representing realized gain at different frequencies within the frequency band of interest (e.g., from 24.25 to 27.5 GHZ in this case) when the second beam 306*b* is radiated at the +60-degree scan angle from the central axis. There is usually a difference in gain when a beam is radiated at the zero-degree scan angle (e.g., the first beam 306*a*) and at +60-degree scan angle (e.g., the second beam 306*b*). The difference between the realized gain between the off-angle beam, for example, the second beam 306*b* that is radiated at +60-degree scan angle, and the first beam 306*a* is radiated at the zero-degree scan angle by the antenna device 102 (FIG. 1A) or the array 200A or 200B of antenna devices (FIGS. 2A and 2B) is referred to as a roll-off. In this case, as shown in the FIG. 3C, a small roll-off of approximately 2.9 dB is achieved over entire frequency range (24.25-27.5 GHz), which is a significant improvement as compared to conventional antenna devices, arrays, and systems where a roll-off of only 5-5.5 dB is achieved as a system requirement.

Figure 3D:
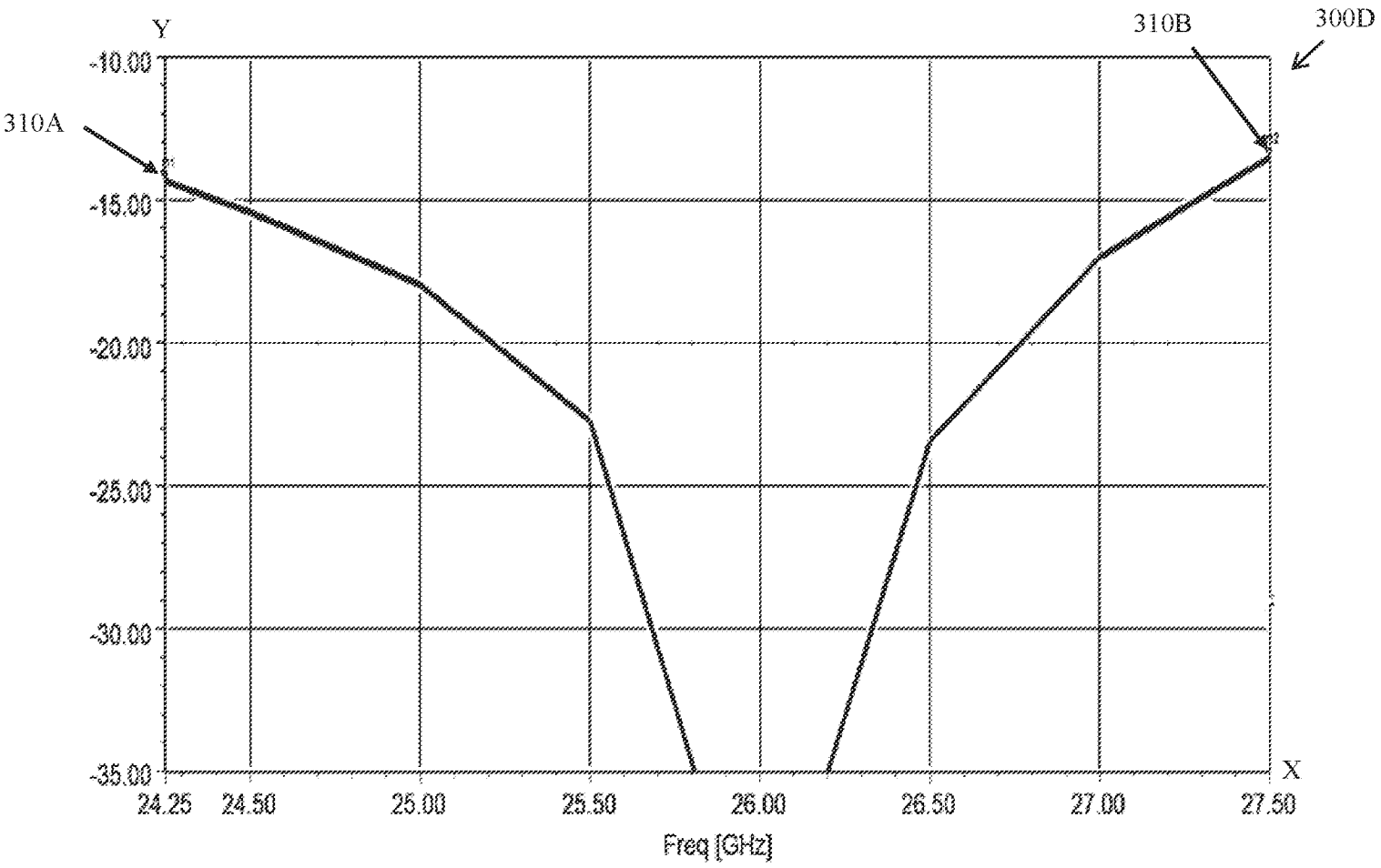
FIG. 3D is a diagram illustrating a graphical representation that depicts polarization isolation between two ports of an antenna device, in accordance with an exemplary embodiment of the disclosure.

FIG. 3D is a diagram illustrating a graphical representation that depicts polarization isolation between two ports of an antenna device, in accordance with an exemplary embodiment of the disclosure. FIG. 3D is explained in conjunction with elements from FIGS. 1A to 1F, 2A to 2C, and 3A to 3C. With reference to FIG. 3D, there is shown a graphical representation 300D that shows frequencies within a defined frequency band in GHz on its X-axis versus realized gain in decibels (dB) on its Y-axis for a broadside radiation. In other words, FIG. 3A shows simulation results depicting enhanced performance of the antenna device 102 of FIG. 1A to 1F, where H/V Port Isolation (S21), i.e., the isolation between the horizontal polarization feeding pin 126A including the first port 130A (H port) (FIG. 1D) and the vertical polarization feeding pin 126B including the second port 130B (V port) (FIG. 1D) is depicted for the broadside radiation. Beneficially, as shown by indicators 310A and 310B (i.e., two thick arrows), the polariton isolation between the two ports 130A and 130B (i.e., H/V Port isolation) is greater than 15 dB. Moreover, beneficially, the polarization isolation is well centered around the 26 GHz frequency which is almost middle of the operating frequencies of the defined frequency band (e.g., 24.24 to 27.5 GHz) in which the antenna device 102 operates, which in turn also results in enhanced bandwidth.

While various embodiments described in the present disclosure have been described above, it should be understood that they have been presented by way of example, and not limitation. It is to be understood that various changes in form and detail can be made therein without departing from the scope of the present disclosure. Embodiments of the present disclosure may include methods of providing the apparatus described herein by providing software describing the apparatus and subsequently transmitting the software as a computer data signal over a communication network including the internet and intranets.

It is to be further understood that the system described herein may be included in a semiconductor intellectual property core, such as a microprocessor core (e.g., embodied in HDL) and transformed to hardware in the production of integrated circuits. Additionally, the system described herein may be embodied as a combination of hardware and software. Thus, the present disclosure should not be limited by any of the above-described exemplary embodiments but should be defined only in accordance with the following claims and their equivalents.

What is claimed is:

1. An antenna device, comprising:

a first patch radiator and a second patch radiator, wherein the first patch radiator and the second patch radiator are configured to radiate in a defined frequency band, wherein the second patch radiator is arranged over the first patch radiator at a defined distance, wherein the first patch radiator has a first side and a second side, wherein the first side of the first patch radiator faces the second patch radiator and the second side of the first patch radiator faces a ground of the antenna device, and wherein the first patch radiator comprises a plurality of slots;

a central ground pin having a first end connected substantially at a center portion of the second side of the first patch radiator and a second end connected to the ground;

a plurality of conductive feeding pins connected to the second side of the first patch radiator and separated by at least one slot of the plurality of slots; and a cell structure having a cavity that comprises a polygonal-shaped base and a metallic fence arranged at four or more side walls of the cavity, wherein the first patch radiator and the second patch radiator are arranged in the cavity of the cell structure and are at least partially surrounded by the metallic fence such that a plurality of antenna control parameters are decoupled from each other.

2. The antenna device according to claim 1, wherein the cavity of the cell structure has an octagonal bowl-like structure having an octagonal-base surface, and wherein an interior of the octagonal bowl-like structure has eight side walls arranged in the form of an octagon, and wherein the metallic fence is arranged at the eight side walls.

3. The antenna device according to claim 1, wherein each of the first patch radiator and the second patch radiator is a square-shaped patch radiator with four L-shaped notched corners.

4. The antenna device according to claim 3, wherein each edge of each of the first patch radiator and the second patch radiator is arranged parallel to a corresponding side wall of the four or more side walls of the cavity of the cell structure.

5. The antenna device according to claim 3, wherein the first patch radiator comprises four slots, wherein each of four slot extends from near the central ground pin towards the four L-shaped notched corners.

6. The antenna device according to claim 1, wherein a size of the first patch radiator is different from the second patch radiator.

7. The antenna device according to claim 1, wherein a size of the first patch radiator is greater than the second patch radiator.

8. The antenna device according to claim 1, wherein the plurality of antenna control parameters comprises a bandwidth, a polarization purity, a polarization terminal isolation, and a scan roll-off parameter.

9. The antenna device according to claim 1, wherein the plurality of conductive feeding pins comprises at least one of: a combination of one horizontal polarization feeding pin and one vertical polarization feeding pin, or a combination of two horizontal polarization feeding pins and two vertical polarization feeding pins.

10. The antenna device according to claim 1, further comprising a multi-layered printed circuit board (PCB), wherein the second patch radiator is printed on a first layer of the multi-layered PCB, and wherein the first patch radiator is sandwiched between the first layer and a second layer of the multi-layered PCB.

11. The antenna device according to claim 1, wherein the first patch radiator and the second patch radiator are arranged in a stacked form in the cavity of the cell structure such that a gap is defined between the metallic fence and different edges of the first patch radiator and the second patch radiator in the cavity of the cell structure.

12. An array of antenna devices, comprising:

a first arrangement of patch radiators that comprises:

a first patch radiator and a second patch radiator arranged over the first patch radiator at a defined distance, wherein the first patch radiator comprises a first plurality of slots;

a first central ground pin having a first end connected substantially at a center portion of the first patch radiator and a second end connected to a ground of the first arrangement of patch radiators;

a first plurality of conductive feeding pins connected to the first patch radiator and separated by at least one slot of the first plurality of slots; and a second arrangement of patch radiators that comprises:

a third patch radiator and a fourth patch radiator arranged over the third patch radiator at the defined distance, wherein the third patch radiator comprises a second plurality of slots;

a second central ground pin having a first end connected substantially at a center portion of the third patch radiator and a second end connected to a ground of the second arrangement of patch radiators;

a second plurality of conductive feeding pins connected to the third patch radiator and separated by at least one slot of the second plurality of slots; and a cell structure having a plurality of cavities, wherein each of the plurality of cavities comprises a polygonal-shaped base and a metallic fence arranged at four or more side walls of each cavity, and wherein the first arrangement of patch radiators is arranged in a first cavity of the plurality of cavities of the cell structure and is at least partially surrounded by the metallic fence of the first cavity, and wherein the second arrangement of patch radiators is arranged in a second cavity of the plurality of cavities of the cell structure and is at least partially surrounded by the metallic fence of the second cavity, and wherein the first arrangement of patch radiators and the second arrangement of patch radiators are arranged in the first cavity and the second cavity, respectively such that a plurality of antenna control parameters are decoupled from each other.

13. The array of antenna devices according to claim 12, wherein each of the plurality of cavities of the cell structure has an octagonal bowl-like structure having an octagonal-base surface, and wherein an interior of the octagonal bowl-like structure has eight side walls arranged in the form of an octagon, and wherein the metallic fence is arranged at the eight side walls of each cavity of the plurality of cavities.

14. The array of antenna devices according to claim 12, wherein each of the first patch radiator, the second patch radiator, the third patch radiator, and the fourth patch radiator comprises is a square-shaped patch radiator with four L-shaped notched corners.

15. The array of antenna devices according to claim 14, wherein each edge of each of the first patch radiator, the second patch radiator, the third patch radiator, and the fourth patch radiator is arranged parallel to a corresponding side wall of the four or more side walls of each cavity of the plurality of cavities of the cell structure.

16. The array of antenna devices according to claim 14, wherein each of the first patch radiator and the third patch radiator comprises four slots, wherein each of four slot extends from near corresponding central ground pin towards the four L-shaped notched corners.

17. The array of antenna devices according to claim 12, wherein a size of the first patch radiator and the third patch radiator is greater than the second patch radiator and the fourth patch radiator.

18. The array of antenna devices according to claim 12, wherein the plurality of antenna control parameters comprises a bandwidth, a polarization purity, a polarization terminal isolation, and a scan roll-off parameter.

19. The array of antenna devices according to claim 12, wherein each of the first plurality of conductive feeding pins and the second plurality of conductive feeding pins comprises at least one of: a combination of one horizontal polarization feeding pin and one vertical polarization feeding pin, or a combination of two horizontal polarization feeding pins and two vertical polarization feeding pins.

20. The array of antenna devices according to claim 12, wherein a height of the metallic fence arranged at four or more side walls of each cavity of the plurality of cavities is substantially equal to a corresponding height of each of the first arrangement of patch radiators and the second arrangement of patch radiators when arranged in the cell structure.

* * * * *